US012270203B2

(12) United States Patent
Piltch

(10) Patent No.: US 12,270,203 B2
(45) Date of Patent: Apr. 8, 2025

(54) METAL ROOF SHINGLE SYSTEM AND METHOD OF INSTALLATION

(71) Applicant: Sanford J. Piltch, Allentown, PA (US)

(72) Inventor: Sanford J. Piltch, Allentown, PA (US)

( * ) Notice: Subject to any disclaimer, the term of this patent is extended or adjusted under 35 U.S.C. 154(b) by 853 days.

(21) Appl. No.: 15/849,515

(22) Filed: Dec. 20, 2017

(65) Prior Publication Data

US 2019/0186139 A1 Jun. 20, 2019

(51) Int. Cl.

| | |
|---|---|
| ***E04D 1/18*** | (2006.01) |
| ***E04D 1/00*** | (2006.01) |
| ***E04D 1/02*** | (2006.01) |
| ***E04D 1/28*** | (2006.01) |
| ***E04D 1/30*** | (2006.01) |
| ***E04D 1/34*** | (2006.01) |

(52) U.S. Cl.

CPC ..... *E04D 1/2956* (2019.08); *E04D 1/025* (2013.01); *E04D 1/18* (2013.01); *E04D 1/28* (2013.01); *E04D 1/2918* (2019.08); *E04D 1/30* (2013.01); *E04D 1/34* (2013.01); *E04D 2001/305* (2013.01); *E04D 2001/3447* (2013.01); *E04D 2001/3461* (2013.01)

(58) Field of Classification Search

CPC .. E04D 1/025; E04D 1/18; E04D 1/28; E04D 1/30; E04D 1/34; E04D 2001/305; E04D 2001/3447; E04D 2001/3461; E04D 3/36; E04D 3/362; E04D 3/40; E04D 1/125; E04D 1/2956

USPC ..... 52/524

See application file for complete search history.

(56) References Cited

U.S. PATENT DOCUMENTS

| | | | | |
|---|---|---|---|---|
| 157,392 A | | 12/1874 | Hamel | |
| 313,853 A | * | 3/1885 | Cortright | E04D 1/125 52/529 |
| 329,789 A | * | 11/1885 | Weast | E04D 1/125 52/530 |
| 334,624 A | * | 1/1886 | Tegethoff | E04D 1/18 52/530 |
| 341,966 A | * | 5/1886 | Thorn et al. | E04D 1/125 52/536 |
| 341,967 A | * | 5/1886 | Thorn et al. | E04D 1/18 52/536 |
| 345,089 A | * | 7/1886 | Walter | E04D 1/125 52/520 |
| 349,966 A | * | 9/1886 | Wightman | E04D 1/125 52/530 |

(Continued)

FOREIGN PATENT DOCUMENTS

| | | |
|---|---|---|
| DE | 10027408 A1 | 6/2001 |
| FR | 1202681 | 9/1958 |

*Primary Examiner* — James J Buckle, Jr.

(74) *Attorney, Agent, or Firm* — Sanford J. Piltch, Esq.

(57) ABSTRACT

A lightweight interlocking metal roof system for installation onto a steep or inclined structure roof either directly over the roof decking material or over an existing shingle roofing system, with the metal roofing system installed from the roof ridgeline down to the drip edge of the roof gutter. Cooperating outwardly extending flanges and receiving pockets for capturing and interlocking the metal panels of the roofing system create an interlock between and among panel members with overlying edge ends configured to be resistant to lift up due to winds either across the roof or along the roof edges.

12 Claims, 10 Drawing Sheets

(56) References Cited

U.S. PATENT DOCUMENTS 359,958 A * 3/1887 Cortright et al. ..... E04D 1/125 52/522
359,959 A * 3/1887 Cortright ..... E04D 1/125 52/531
460,283 A 9/1891 Adler
1,519,350 A * 12/1924 Belding ..... E04D 1/18 52/522
1,861,998 A * 6/1932 Bennett ..... E04D 1/18 52/277
1,876,597 A * 9/1932 Bennett ..... E04D 1/18 52/520
1,940,243 A * 12/1933 Carlson ..... E04D 1/18 52/534
2,598,497 A * 5/1952 Brown ..... E04D 1/125 52/524
2,882,840 A 4/1959 Waske
2,961,804 A 11/1960 Beckman
3,312,031 A 4/1967 Berg
3,394,515 A 7/1968 Widdowson
3,667,184 A 6/1972 Merrill et al.
4,079,561 A * 3/1978 Vallee ..... E04D 1/125 52/520
4,218,857 A 8/1980 Vallee
4,244,151 A * 1/1981 Seem ..... E04D 3/351 52/309.9
4,817,506 A * 4/1989 Cashman ..... E04D 13/174 454/365
5,349,801 A 9/1994 Verbofsky
5,442,888 A * 8/1995 Ilnyckyj ..... E04D 1/125 52/524
5,457,920 A * 10/1995 Waltz ..... E04D 13/174 454/365
5,469,680 A 11/1995 Hunt
5,495,654 A 3/1996 Goodhart et al.
5,613,337 A * 3/1997 Plath ..... E04D 1/18 52/519
5,657,603 A 8/1997 Goodhart et al.
5,711,127 A 1/1998 Sabourin
5,784,848 A * 7/1998 Toscano ..... E04D 1/265 52/519
5,799,460 A 9/1998 Jensen
5,956,913 A 9/1999 Nicholson
6,173,546 B1 1/2001 Schafer
6,557,315 B2 5/2003 Tremblay
RE38,210 E 8/2003 Plath et al.
6,619,006 B1 9/2003 Shirota
6,708,463 B2 3/2004 Chai
6,793,574 B1 * 9/2004 Robinson ..... E04D 13/174 454/364
6,883,290 B2 4/2005 Dinwoodie
7,168,221 B2 1/2007 Hunter, Jr.
7,980,036 B2 7/2011 Takayasu et al.
8,191,326 B2 6/2012 Shapiro
8,728,609 B2 * 5/2014 Torres ..... E04D 1/08 428/157
8,898,963 B1 12/2014 Amatruda et al.
9,091,082 B2 7/2015 Wakebe
9,243,408 B2 * 1/2016 Nicholson ..... E04D 1/18
9,695,594 B2 * 7/2017 Van Wey ..... E04D 13/176
2006/0053709 A1 3/2006 Kim
2006/0207194 A1 * 9/2006 Salles, Jr. ..... E04D 1/125 52/81.4
2010/0186334 A1 * 7/2010 Seem ..... E04D 1/18 52/539
2014/0190104 A1 7/2014 Nicholson
2015/0089885 A1 4/2015 Wakebe
2016/0194878 A1 * 7/2016 Tenute ..... E04D 1/18 52/528
2017/0145695 A1 * 5/2017 Piltch ..... E04D 1/18

* cited by examiner

METAL ROOF SHINGLE SYSTEM AND METHOD OF INSTALLATION

RELATED U.S. APPLICATION DATA

The present application is a continuation-in-part of U.S. application Ser. No. 14/947,312 filed on Nov. 20, 2015 that remains pending.

BACKGROUND OF THE INVENTION

The present invention is directed to a formed sheet metal roofing system for installation on a pitched roof beginning at the roof ridge and ending at the eave. The invention includes thermally insulative, self-sealing, non-visible interlocking formed sheet metal shingles that provide a substantially watertight seam between adjacent shingles without the need for additional sealant materials. The invention eliminates the need to add the potentially prohibitive weight of present roofing methods to the roof of a structure, which makes an old roof "tear off" mandatory, incurring more landfill pollution, non-productive expenses, and unnecessary risks to the property. The combination of non-visible interlocking joints, shaped or formed shingle edges, and an applied paint system provide the sheet metal roofing system with the appearance of slate shingles, terracotta tiles, or like roofing materials.

Water penetration is one of the most significant problems with regard to roofing materials and applied roofing techniques. Water penetration in metal roofing systems is equally problematic, primarily at any joint between adjacent metal roof pieces. The penetration of water, snow and ice melt, as well as wind driven water between adjacent metal shingles is a well known problem in the field. Such water problems being most severe in roofs having only a moderate pitch, for example, roofs having a pitch in a range between a 2 inch rise over a 12 inch span to a 4 inch rise over the same span. The more shallow the pitch, the greater the potential for roof leaks. Water penetration or leaking can occur by capillary action along a seam or joint between roofing pieces, or by wind-driven penetration of the outer skin of the roofing material, among other reasons. The water penetration site is difficult to detect and problematic to cure and prevent from happening again at the same site.

It is, therefore, desirable to make the formed metal roofing shingles or panels not only easy to manufacture and handle, but also easy to install and effective at creating watertight seals between adjacent panels to keep out the onslaught of rain, hail, snow, heat, and other environmental factors. Additionally, water run off from the present invention is considered environmentally safe and non-toxic due to the outer painted skin and the resistance to chemical breakdown due to significant temperature changes and elongated periods of heat or cold affecting the integrity of the panels. Moreover, the shingles or panels will not delaminate or deconstruct over time and will not give off pollutants into the atmosphere as do asphalt-based shingles contributing to the effect known as "global warming."

Prior roof panel systems, which may have been easy to interlock, often created inadequate seals between adjacent opposing panel edges requiring additional sealant materials to maintain a seal resistant to water penetration over time. Moreover, metal roofing panels that created better watertight seals were often more complicated to interlock or install, and are more difficult to manufacture, making the panels significantly more expensive. Panels which are difficult to install correctly are all the more troublesome when in the hands of inexperienced tradesmen or do-it-yourselfers, with the result that the integrity of the roof system winds up being compromised either immediately, or in an unacceptably short period of time.

The present formed metal panel roof shingle system is constructed using pre-shaped aluminum roofing panels containing an insulative material as both a support member and an insulation barrier for resistance to thermal conductivity in all seasons. Aluminum tends to reflect heat and conserve energy, as opposed to asphalt or fiberglass shingle systems used in the past which could increase energy needs year round. Further, the structural insulative material provides an additional thermal barrier while also providing support to the outer surface of the formed metal roof shingles so that walking across the roof will not crush the surface inward into the structure and potentially compromise the integrity of the joints between the panels.

Contrary to existing methods of application of the roofing shingles in which an installer starts at the bottom and works up, the design of the present system allows the installer to start at the top and work downward along the roof decking material. This approach, combined with the lightweight of the aluminum, eliminates the major problems inherent in all roof shingle applications, i.e., installing over already placed shingles and the weight factor of the materials, as well as water penetration and run off under finished roof sections or onto any unfinished sections of the roof. Moreover, the present system of panels resists deformation by winds because of the way the panels are interlocked with all overlying edges fitted securely to, and locked over the edges of the existing roof structure.

Past problems with prior metal roof shingle applications included mandatory removal of the old shingles, due to the additional weight added by the new shingles. The present invention overcomes this problem because it is lightweight, fits immediately adjacent and overlies the present roofing system, and preserves the existing roofing material for use as additional insulation instead of removing the material.

A need exists for a roofing system that will allow an installer to start applying shingles from the top, at the ridge of the roof, and work downward, instead of from the bottom or eave edge to the roof ridge at the top. The present invention fulfills this need by starting the application of shingles at the top, making it possible to nail 2×4's into the roof as "toe-holds" to work from, instead of the conventional scaffolding methods. The method of installation of this new roofing system additionally prevents any risk of damaging the newly laid roof. Also, the dirt and traffic are confined to the unfinished roof area, and the toeholds are repositioned as the work progresses down the roof. This process makes the application process safer, and reduces the problems of working over the roofing materials just placed so that an unskilled do-it-yourselfer can easily do the job almost as well as an experienced professional installer. The new roofing system stays neat, clean, undamaged and watertight throughout the job.

A need also exists for a cost-effective roofing system. Prior roofing systems required a professional roofer to be contracted to do the job and the majority of the roofing cost was in the labor. The metal roof shingle system of the present invention can be installed by anyone, a professional roofer is not necessary; keeping the cost lower. Moreover, the metal roof shingle system will last longer than fifty years, will resist wind uplift problems, reducing insurance claims, and is fireproof.

In addition, the water runoff from the metal roof shingle system is environmentally friendly and non-toxic and the roofing material will not delaminate or deconstruct due to exposure to the normal environment. Present roofing systems, while chemically and physically breaking down due to lengthy exposure to temperature extremes, tend to give off environmentally unfriendly hydrocarbons into the atmosphere as the effect of the solar rays striking the roofing materials heats the shingles and actually cooks the life giving oils out of the shingle so that they dry out, delaminate, become brittle, and fall apart. This aging of present roofing systems tends to lead to the roofing materials becoming extremely vulnerable to wind damage resulting in insurance claims for leaks that tend to affect the entire structure.

There have been various attempts in the past to overcome roof leak problems associated with metal roofing shingles. For example, U.S. Pat. No. 1,519,350 [Belding] describes a sheet metal shingle installed from the roof ridge to the eave. The metal shingle includes interlocking joints along the top or weather surface that couples adjacent shingles together. Such exposed joints between shingles are pelted with rain, sleet and snow and exposed to the radiation and heating of the sun such that they are prone to repeated expansion and shrinkage causing the potential for water penetration. Although Belding also describes a ridge cap section, the element is significantly different from the ridge cover utilized with the metal shingles of the present invention.

An attempt at obtaining a better water-tight seal between adjacent metal shingles is shown and described in U.S. Pat. No. 3,394,515 [Widdowson] as a deformable gasket in a channel along a side edge of a metal roofing panel. The gasket forms a seal with an interlocking edge of an adjacent panel. Another patent, U.S. Pat. No. 5,349,801 [Verbofsky], describes the joint between adjacent metal shingles requiring the application of a sealant material at the job site to create a water-tight joint between interlocking adjacent shingles. Verbofsky specifically teaches that it is important to form a good bond between the applied sealant and the shingle surface otherwise a poor quality seal will potentially lead to water seepage through the metal roofing material.

Another metal shingle system is described in U.S. Pat. No. 4,079,561 [Vallee] and in U.S. Pat. No. 4,218,857 [Vallee] that shows a starter shingle located at one end of a roof at the eave with shingles affixed to the roof using the starter shingle as the point of origin. The metal shingle roofing system does not appear to provide for appropriate water runoff from an upper shingle to a lower shingle that could cause ponding in one or more lower shingles and water penetration through joints between adjacent shingles.

Another sheet metal shingle is described in U.S. Pat. No. 5,442,888 [Ilnyckyj] showing a square roofing shingle having a partial insert of foamed sheet polystyrene to create an incline in the shingle when laid. Unfortunately, this shingle system is laid from the eave to the roof ridge and is designed for partial overlayment of an upper course of shingles on a lower course. Water runoff is handled only by the overlying of the shingles with gravity controlling the water path. There does not appear to be any guard against ice damming or the upward wicking of water under the upper course shingle and penetrating the roof system.

Accordingly, there appears to be a long-felt need in the art for a metal roofing system with universal flashing and unexposed or hidden interlocking joints that resist water penetration without the need for applied caulks, sealants, adhesives and the like. There also appears to be a need for the inclusion of insulating materials as part of the metal roofing shingle that provides both a thermal barrier and structural support to the formed metal roofing shingles. Further, the water-shedding shingle design of the present invention provides a metal roofing system that will be especially suited for application on shallower pitched roofs.

It is, therefore, an object of the present invention to provide a watertight formed metal roofing shingle system having shingles or panels of a design to maximize downward water-shedding with installation of the shingles beginning at the roof ridge line and ending at the eave edge. It is another object of the present invention to provide a formed metal roofing shingle system having no exposed joints between adjacent shingles so that the finished roof has an uninterrupted level surface. It is still another object of the present invention to provide a metal roofing shingle system that includes universal flashing between and among the various component shingles or panels of the roofing system with interlocking joints that couple adjacent metal shingles or panels together at the precise opposing distance creating a uniform level surface.

It is yet another object of the present invention to provide a metal shingle roofing system with unexposed interlocking compression joints that produce a water-tight connection between adjacent metal shingles and other roofing components. It is also an object of the present invention to provide a lightweight metal roofing system with included insulative barrier and support member that is suitable for overlying an existing roofing system without the need to remove the existing roofing system. It is another object of the present invention to take advantage of the creation of a level surface and add selected paint systems to the surface to create faux slate or terracotta tile looking visual effects for the metal roofing system of the present invention.

Other objects will appear hereinafter.

SUMMARY OF THE INVENTION

The present invention is a formed sheet metal roofing system for installation on a pitched roof beginning at the roof ridge and ending at the eave. The sheet metal roofing system is comprised of a plurality of interlocking, thermally insulative metal roof panels, forming a roofing system, which can be used for new roofs and pre-existing roofs which are inclined. The invention includes thermally insulative, self-sealing, non-visible interlocking formed sheet metal shingles that provide a substantially watertight seam between adjacent shingles without the need for additional sealant materials. A fitted panel of structural closed cell insulation is placed within each metal roof panel before each metal panel is affixed to the roof to create an additional insulative barrier and outer surface support to prevent crushing of the metal roof panel.

Each of the formed metal roofing panels interlocks with one or more adjacent roofing panels to form a contiguous roofing surface structure. The interlocking panel includes a substantially planar surface which faces outward having a plurality of parallel edges that is spaced upward and apart from the roof decking surface forming a recess within the formed plurality of panel edges. The recess, formed on the underside of the planar surface which faces towards the roof decking forms a pocket for receiving a structural sub-panel that provides support for the outer planar surface against crushing as well as providing thermal insulation for the formed metal panel.

The outer planar surface has adjacent upper side indents along the entire length of each upper side such that the respective sides fit into a receiving pocket of an adjacent roofing panel. Each roofing panel has along its lower adjacent sides a receiving pocket situate between an outwardly extending nailing hem along the bottom of the pocket and an outwardly extending flange along the top of the pocket for overlying the joint between adjacent panels a predetermined distance equivalent to the width of the indent along the upper sides of the planar surface of the adjacent roofing panel or panels. Upon insertion of a lower panel into the receiving pocket of an upper panel frictional contact within the cooperating pocket and extending along the entire length and depth of each receiving pocket of the panel retains the adjacent lower panels in place as each such panel is inserted into the receiving pocket of the upper adjacent panel. In this way the panels cascade or step down a half panel span each time they are joined together.

Each roofing panel has a pair of adjacent flat edges along their lower sides that accommodate a pair of pockets to receive the outwardly extending flange from the adjacent panel or panels placed below them along the downward slope of the roof. In this fashion each panel fits into another, and all interlock tightly into the receiving pocket which has a lower extended flange that also forms a nailing hem, to mechanically secure the lower edges of the panel to the roof, and an upper extended flange for covering and overlying the frictional joint between panels. Insertion of the next panel into the pocket of the already fastened down panel covers over the fasteners along the nailing hem so that these fasteners are also not exposed or subjected to adverse environmental effects.

Each panel has an exposed upper surface that is shaped to form a square or rectangle and measures, for example, approximately 10×10 inches. The panels are intended to form an array that positions the rectangular shape with its top and bottom corners directly above one another on a line extending vertically upward along the roof decking. Oriented as described, each panel has two adjacent lower sides with receiving pockets and two adjacent upper sides. The upper sides have outwardly extending projection members or flanges for partially forming the joint extending along substantially an entire lower side of each panel. The outwardly extending projection members slide into the receiving pocket situate along the lower sides of the adjacent upper panels tightly fitting together by frictional contact and creating a hidden joint between and among the panels. Each receiving pocket is about one and a half to two inches in depth. The interstitial space formed within the receiving pocket is nominally twice the thickness of the metal material along the underside of the pocket, ranging between approximately ¼ to ½ inches.

A ridge base member contains at least a pair of receiving pockets on opposing lower sides of a geometric shape, preferably an isosceles triangle, which allows the ridge base member to exactly engage the outwardly extending projection members along the upper side of adjacently placed panels. The lower adjacent sides of the ridge base member, which may be repeated along several sections of a base member made as an integral single piece, include the receiving pocket situate between an outwardly extending nailing hem along the bottom of the pocket and an outwardly extending flange along the top of the pocket for overlying the joint between adjacent panels a predetermined distance equivalent to the depth of the indent along the upper sides of the planar surface of the adjacent lower roofing panel or panels.

A ridge cap member is also part of the present system and is of a longer size than the standard panels, typically 4 feet or longer. The ridge cap member is bent at the middle of its width along the entire length of the member to fit snugly at the proper angle over the ridge base member or members situate along the ridge of the roof, or a dormer on the structure. The ridge cap member is invertible to form a valley between inclined sections of the roof set at an angle to one another that overlie the straight-line junction between the inclined sections and allow rain water and snow melt to flow down the valleys of the roof structure to the gutters.

Alternatively, a ridge cap member capable of spanning the roof ridge line and including pockets extending along the entire length of opposite lower sides for receiving a plurality of ridge base members within the pocket. Also provided is a ridge cap member with air vents to accommodate roofs that require venting. This ridge cap member accommodates the ridge base members in the same fashion with the remainder of the roof system attaching in the same fashion as described herein.

Roof edge members are formed of a geometric shape, preferably an isosceles triangle, which allows each ridge edge member to interlock with a pocket of an adjacent roof panel and to exactly engage the outwardly extending projection member or flange along the upper side of another adjacent roof panel. Each roof edge member contains a receiving pocket along its lower facing side with an outwardly extending flange along the top of the pocket for overlying the joint between the adjacent panels a predetermined distance equivalent to the depth of the indent along the upper sides of the planar surface of the adjacent lower roofing panel. On the upper facing side each roof edge member contains a depressed flange to engage, by frictional contact, with the adjacent upper panel pocket. The roof edge members may be formed in a series or be separate, individual panels. Each roof edge member may also include a roof edge extension that extends over the roof edge a distance downward below the decking to be secured to the structure below the roofline eliminating the need for new flashing and preventing wind uplift.

The outwardly extending leg of the pocket sides of each panel forms a nailing hem along the bottom of the pocket so that the panel can be secured mechanically into the roof decking of the structure. The receiving pocket will interlock with the opposing flat, straight side of the depressed flange of the next adjacent panel that can be inserted to interlock with the already secured panel. Each panel is fastened mechanically to the roof by means of a roofing nail, screw or staple. The opposing side of the next panel is an insertable flange depressed slightly downward from the level of the outer surface of the panel that cooperates with and is inserted into the receiving pocket to create the interlocking joint. The panels are dimensionally sized and squared in an identical fashion and are precisely butted against one another when they are joined, thereby hiding all of the connection points and fasteners. A cascading downward half-step is created as the panels are interconnected from the ridge or top of the roof to the bottom or eave. This cascading half-step allows water and other run off to move downward over the joints covered over by the upper flange extensions along the pocket sides of the panels and prevents water from collecting on the roof and causing penetration or leakage into the structure.

When the bottom or eave of the roof is reached, each roof bottom edge member may also include a roof edge extension that extends over the roof edge at the eave and extends a distance downward below the decking to be secured to the structure below the roofline eliminating the need for new flashing preventing wind uplift and water penetration. The included structural insulation contained within the recess on the bottom side of each roof panel creates a thermal barrier which significantly reduces any transmission of heat or cold in or out of the building structure through the roof.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENT

The following detailed description is of the best presently contemplated mode of carrying out the invention. This description is not intended in a limiting sense, but is made solely for the purpose of illustrating the general principles of the invention. The various features and advantages of the present invention may be more readily understood with reference to the following detailed description, taken in conjunction with the accompanying drawings, wherein like numbers refer to the same feature or part thereof.

Figure 1:
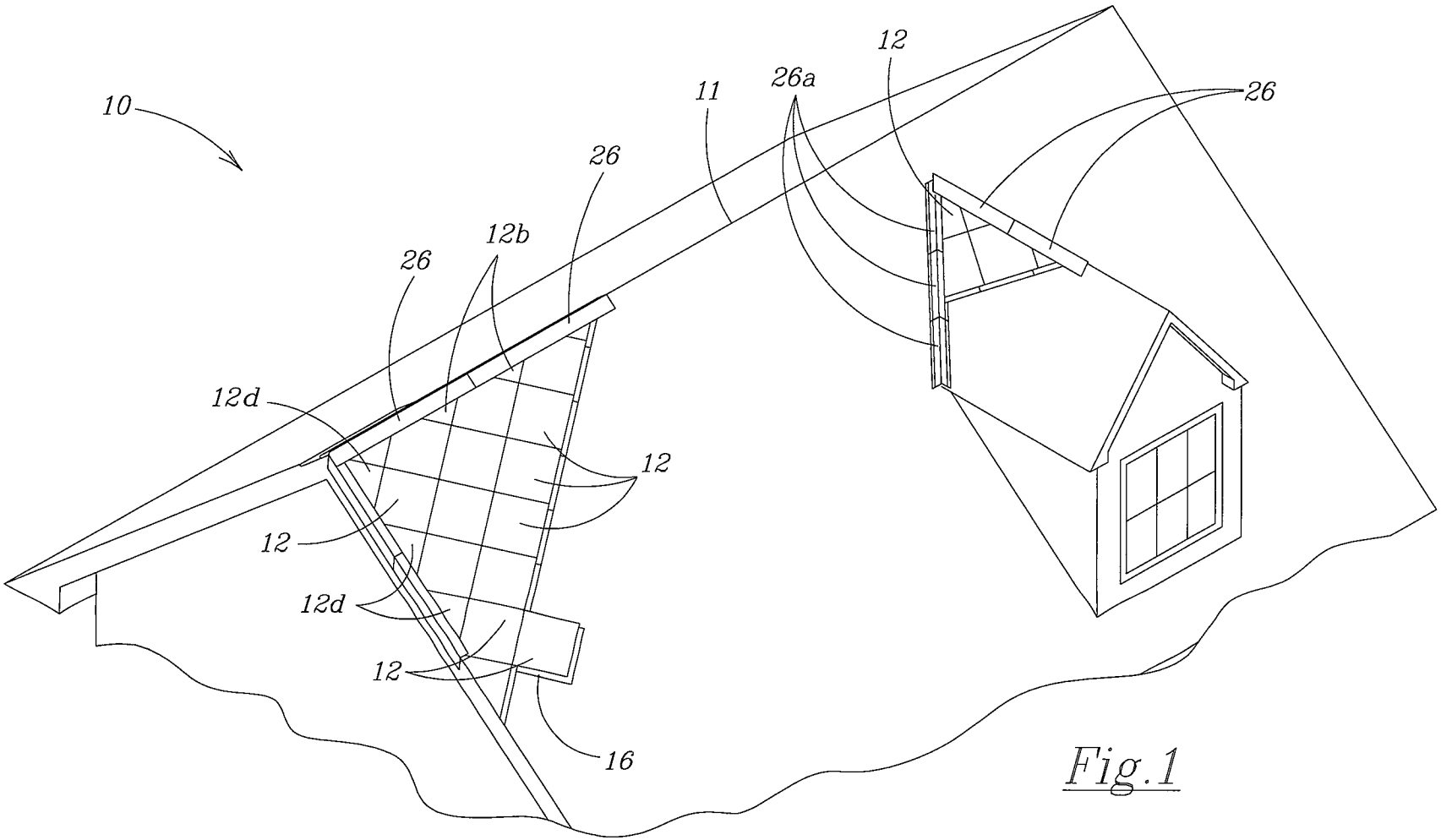
FIG. 1 is a perspective view of a residential structure roof showing sections of the formed metal panel roof system of the present invention along the upper roof sections to demonstrate the cascading half-step formed in a downward direction as the roof panels interlock.

Referring now to FIGS. 1-6, and in particular to FIG. 1, there is shown a formed panel metal roofing system 10 for installation on a pitched roof with interlocking panel members 12 that can be overlaid directly on top of an existing asphalt shingle roof, or directly atop the roof decking, or on top of an additional structural insulative layer if one is requested by the structure owner. Arrayed along the ridge line of the roof are interlocking ridge cap members 26 [FIG. 6A] that overlay a short distance of each other as they progress along the ridgeline of the roof and along the ridgeline of the dormer section. Also, each of the ridge cap members 26 overlay the series of partial rectangular roof ridge panel members 12*b* as the other metal roof panels 12 are arrayed downward from the ridgeline of the roof of the structure, and along the dormer. An inverted gutter panel 26*a* [FIG. 6B] is used along the valley created between two adjacent sections of the roof that are at right angles to each other such as between the main roof decking area and the dormer.

Figure 2:
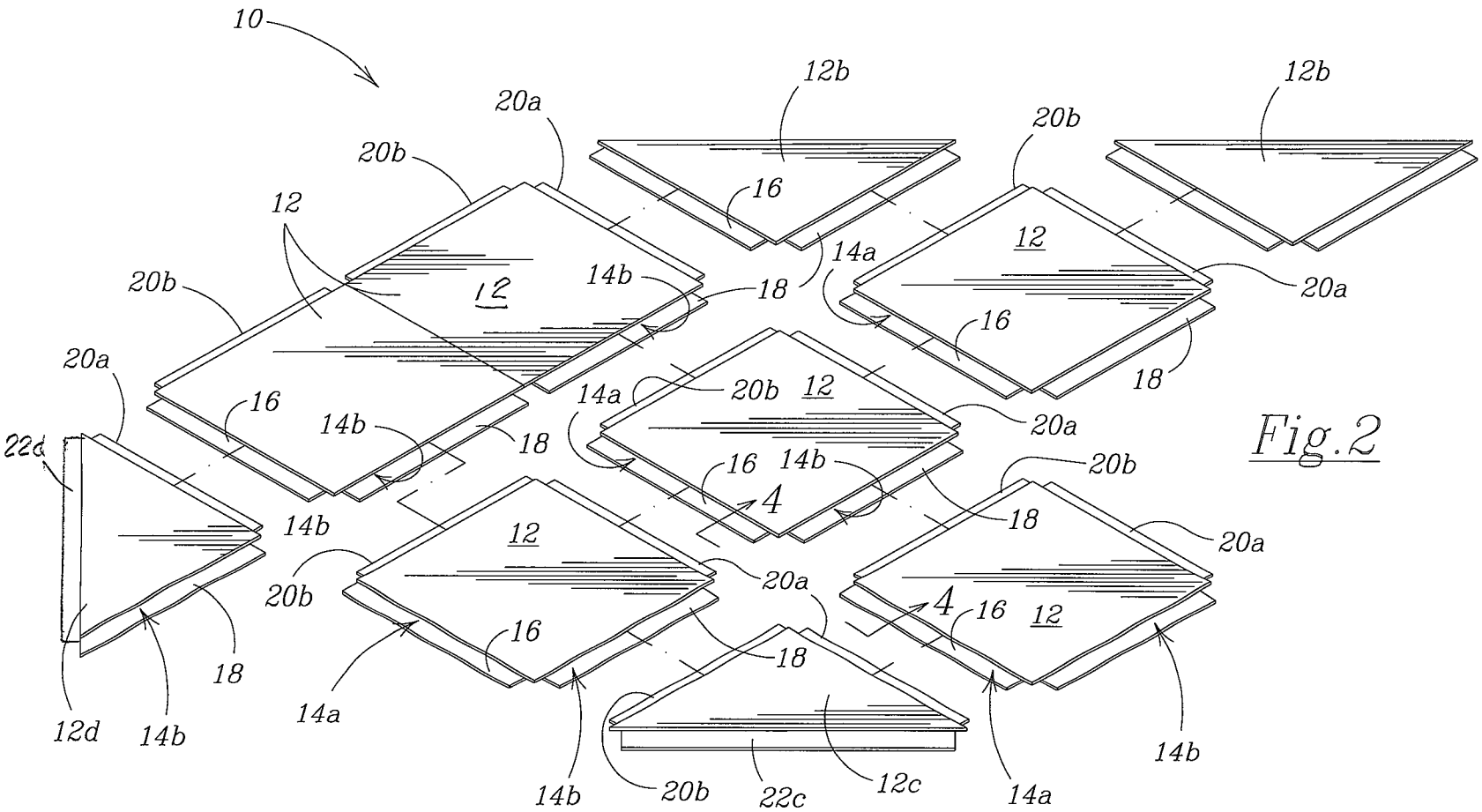
FIG. 2 is an exploded view of several interlocking panel members of the formed metal panel roof system of the present invention with two of the starting panel members along the roof ridge showing the interlocking members of the various panels outward toward one side and to the bottom or eave.
Figure 3:
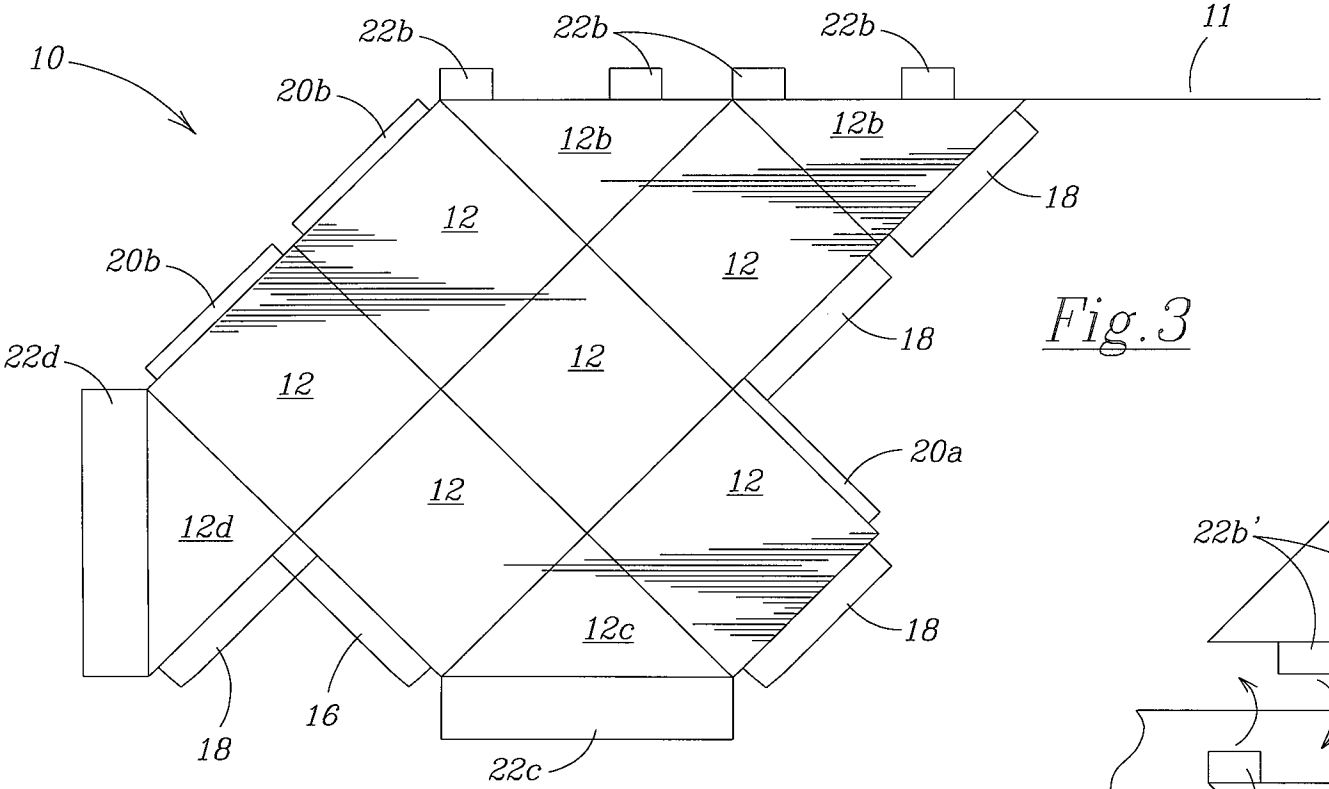
FIG. 3 is an enlarged plan view of the several panels of the formed metal panel roof system of the present invention as they would be installed and interlocked along the ridge, side and bottom of the roof of the building structure.
Figure 3A:
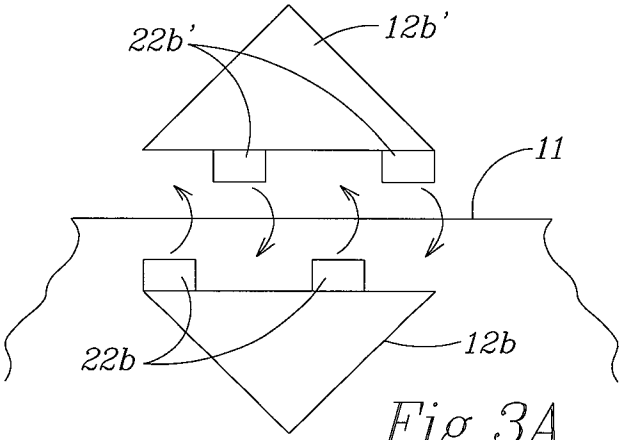
FIG. 3A is a plan view of opposing roof ridge spanning panels arrayed along opposing sides of the roof ridge showing location and placement of securing tabs.

With reference to FIGS. 2, 3 and 3A, each of the interconnecting metal roof panel members 12 are placed along the roof deck with opposing vertices of the substantially rectangular panel in substantial vertical alignment up and down the roof deck. Each panel member 12 has a pair of adjacent receiving pockets 14*a*, 14*b* shown along the downward facing sides or bottom edges of the panel members. Each of the receiving pockets 14*a*, 14*b* has an underside extending flange 16, 18 used as a nailing hem for supporting a cooperating outwardly extending engaging flange 20*a*, 20*b* from an adjacent panel 12. Along the left side of the roof a side edge panel 12*d*, at the left of FIG. 2, has a folded edge 22*d* [FIG. 7D] for hooking over the existing roof decking material and creating a flashing along the side edges of the roof structure. The folded edge 22*d* is secured by fasteners to the outer structural member of the roof decking, sometimes called the barge board, overlapping any other fascia that may have been attached to protect the soffit under an eave.

The exploded view in FIG. 2 shows how an array of panels 12 can be fit together such that the panels create an overlapping effect as they are placed across and downward along the roof. More specifically, the interlocking arrangement of panels and the creation of a planar outer surface between and among the several panels 12 can be better viewed with reference to the plan view of FIGS. 3 and 5 to be discussed below. Each of the metal roof panels 12 has first and second upper sides with each side having an extending flange 20*a*, 20*b*. Further, each panel 12 has two lower sides with each having a receiving pocket 14*a*, 14*b* for engaging and interlocking with the respective extending flanges 20*a*, 20*b* of adjacent panels. As shown in FIG. 2, the central panel 12 has an upward extending flange 20*a* along its upper right side that will engage the edge receiving pocket 14*a* in the panel 12 to the upper right. The central panel 12 also has an upward extending flange 20*b* along its upper left side that will engage the edge receiving pocket 14*b* in the panel 12 to the upper left. The reference central panel 12 also has a downward extending nailing hem 16 and receiving pocket 14*a* along its lower left side for engaging the flange 20*a* from the panel 12 to the lower left. The central panel 12 also has a downward extending nailing hem 18 and receiving pocket 14*b* along its lower right side for engaging the flange 20*b* from the panel 12 to the lower right. Each of the various panels 12 has the same elements in the same positions as described for the central panel 12.

Moving down one-half course in FIG. 2, and assuming that the panels 12 to the lower left and right of the central panel 12 are joined and interlocked with the central panel 12, bottom edge panel 12*c* can be joined to the existing interlocked group of panels 12. Bottom edge roof panel 12*c* that is shaped in the form of an isosceles triangle to match the length of the sides of the panels 12 has the same elements as the central panel 12 extending upward along each of its two upper sides with each side having an extending flange 20*a*, 20*b*. Each of these flanges will respectively be insertable into and interlock with the respective receiving pockets 14*a* and 14*b* of the panels 12 to the upper right and left of bottom edge panel 12*c*. Bottom edge panel 12*c* also has an extended folded edge 22*c* for hooking over the existing bottom edge of the roof decking material and creating a flashing along the bottom edge of the roof structure. The folded edge 22*c* is secured by fasteners to the outer structural member of the roof decking, sometimes called the fascia board, overlapping any other fascia that may have been attached to protect the soffit under the eave.

Moving to the left side of FIG. 2, there is shown a left edge roof panel 12*d*, that is shaped in the form of an isosceles triangle to match the dimensions and shape of the sides of the panels 12, has the same elements as the central panel 12 with a flange 20*a* extending upward from its upper right side and a receiving pocket 14*b* and nailing hem 18 extending downward from its lower right side. The flange 20*a* will engage and interlock with the receiving pocket 14*a* of the panel 12 to the upper right and the receiving pocket 14*b* will provide for interlocking with a panel 12 (not shown) to the lower right. Along the outer edge of left edge panel 12*d* is the folded edge 22*d* for hooking over the existing roof decking material and creating a flashing along the side edges of the roof structure as described above. Reference may be made to FIG. 3 as showing the extended folded edge 22*d* for extending over and around the roof deck and securing to a point below.

Along the ridge line 11 of the roof a series of roof ridge panels 12*b* are arrayed that are also shaped in the form of isosceles triangles to match the dimensions and shape of the sides of the panels 12. Each of the ridge roof panels 12*b* has the same elements as the central panel 12 with a receiving pocket 14*a* and nailing hem 16 extending downward from its lower left side and a receiving pocket 14*b* and nailing hem 18 extending downward from its lower right side. The receiving pocket 14*a* will engage with and interlock the flange 20*a* from the panel 12 to the lower left of the ridge roof panel 12*b* and the receiving pocket 14*b* will do the same with the flange 20*b* from the panel 12 to the lower left of the panel 12*b*. Ridge roof panel 12*b* also has a pair of nailing tabs 22*b* that extend over the ridge line 11 of the roof decking material and provide an anchoring point for the ridge roof panel 12*b*. With reference to FIGS. 3, 3A, the tabs 22*b* are positioned such that the tabs 22*b* and 22*b*' of opposing roof ridge panels 12*b* will not overlap and can be accessed by lifting one panel 12*b* to secure the opposing panel 22*b* in position on the roof. Any fastener, nails, screws or staples, can be used to affix the ridge roof panel tabs 22*b*, 22*b*' to the roof decking material, or to whatever material is being used as an underlayment.

Figure 4:
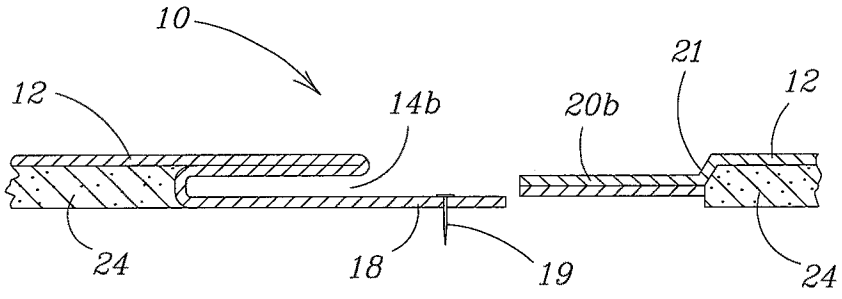
FIG. 4 is a side elevational view of the interlocking joint of adjacent panels of the present invention taken along Line 4-4 of FIG. 2.

Referring to FIG. 4, two adjacent metal roof panels 12 are shown in an exploded side elevational view to describe the interlocking fit between adjacent panels. The left panel 12 has a rightward opening receiving pocket 14*b* with a nailing hem 18 extending beyond the pocket to the right along the bottom of the panel 12. The outer metal skin of the panel 12 is shown traversing across the top of the panel, then extending outward to the right a predetermined distance, then folded back underneath the top facing outer skin, and then folded outward again allowing for a predetermined dimensional space to form the receiving pocket 14*b* with the nailing hem 18 along the bottom extending outward to the right. The extended flange 18 is used as a nailing hem and a roofing nail 19 is shown passing through the flange 18. To the right is another panel 12 having a leftward facing outwardly extending flange 20*b* for fitting into and interlocking with the receiving pocket 14*b* of the left panel 12. The flange 20*b* of the right panel 12 extends downward a distance to dimensionally accommodate the upper portion of the receiving pocket 14*b* and then outward to the left (as shown) and will lie on top of and be positioned to slide against the nailing hem or flange 18 and into the receiving pocket 14*b* and over the mechanical fastening means 19, i.e., roofing nail, screw or staple, to form the interlock between the right and left panels 12. The outer metal skin of the right panel 12 is shown traversing across the top of the panel, then depressed downward slightly forming a depression or detent 21 to begin the extended flange 20*b*. The detent 21 is dimensioned to have a depth equivalent to the folded over depth dimension of the upper portion of the opposing receiving pocket 14*b* of the adjacent panel 12 and to accommodate that upper portion of the opposing receiving pocket 14*b* into the detent 21 so that the surfaces of the joined panels 12, 12 are flat and level forming a substantially continuous surface when joined together. The metal skin of the right panel 12 is then folded back underneath the upper portion of the flange to form at least a double thickness ending at the point where the detent 21 begins. This formed flange 20*b* is then capable of frictional engagement with the pocket 14*b* of the adjacent panel 12 with the flange 20*b* overlying the nailing hem 18 of the adjacent panel 12.

Between the inner sides of the receiving pocket 14*b* and the detent 21 for the flange 20*b*, as well as the other receiving pocket 14*a* and the detent 21 for the flange 20*a*, a recess is formed within panel 12 that houses structural thermal/sound insulation 24. The structural insulation 24 is tightly fit within the recess and held in place either by frictional contact along its edges or by an adhesive placed across the underside of the metal skin within the recess so that the insulation 24 is captured by and remains within the recess.

Each of the cooperating flanges 20*a*, 20*b* and receiving pockets 14*a*, 14*b* of immediately adjacent panels 12 are dimensioned to be able to tightly fit into and frictionally engage each other such that the receiving pockets 14*a*, 14*b* have an approximate separation dimension of approximately 0.140 inches, which is nominally the thickness of the projecting flanges 20*a*, 20*b* having an approximate thickness of 0.125 inches, with a pocket depth ranging between 1 and 2 inches. The proportionality of the separation dimension of the receiving pockets 14*a*, 14*b* is intended to be slightly more than twice the thickness of the metal skin of the metal roof panels in view of the folding or doubling over of the metal skin to form the flanges 20*a*, 20*b*. Thus, the separation dimension of the receiving pockets will be slightly more than twice the thickness of the metal skin regardless of the actual thickness utilized for the metal roof panels 12. The penetration of the flanges 20*a*, 20*b* into the receiving pockets 14*a*, 14*b* is substantially the same distance as the overlay of the upper portion of the receiving pockets 14*a*, 14*b* over the respective detents 21 in the adjacent panels 12. The detents 21 are formed with a dimensional height difference from the upper surface of the panels 12 of just slightly more than twice the thickness of the metal skin of the panel, e.g., 0.140 inches. In this manner the overlay and depth of insertion between the cooperating structures of each panel 12 create an integral joint between adjacent panels 12. See, FIGS. 5 and 5A.

The outwardly extending flanges 20*a*, 20*b* of the two panels 12 of FIG. 2 immediately adjacent to and below the roof ridge panels 12*b* are also capable of fitting within the opposing cooperating formed pockets 14*a*, 14*b* along the bottom edge of adjacent roof ridge panels 12*b*. Overlying each opposing ridge panel 12*b* positioned on either side of the roof ridge line is a ridge cap panel 26. See, FIGS. 1, 5A. The ridge cap panel 26 has a bend along the entire length of its centerline to fold over and fit snugly against the roof ridge panels 12*b* positioned along the ridgeline 11 of the steep or inclined roof. Each side edge of the ridge cap panel 26 is held in place by a fastener that extends through the ridge roof panel 12*b* and/or the roof panel 12 and into the underlayment or decking material to hold the cap 26 in place. Each roof cap panel 26 slightly overlaps the adjacent roof cap panel 26 so that there is an overlapping joint formed preventing water penetration of the joint. At the end of the roof, the ridge cap panels 26 may be configured to overlap the roof and fascia by including a bent end section, like 22 of the panels 12, that overlies the roof edge as described above to hold down the roofing panels and prevent wind lift and water seepage. The ridge cap panels 26 extend along the ridgeline of the structure roof, and may also be utilized to extend along the ridgeline of a dormer section of a roof as also shown in FIG. 1.

Figures 6A, 6B:
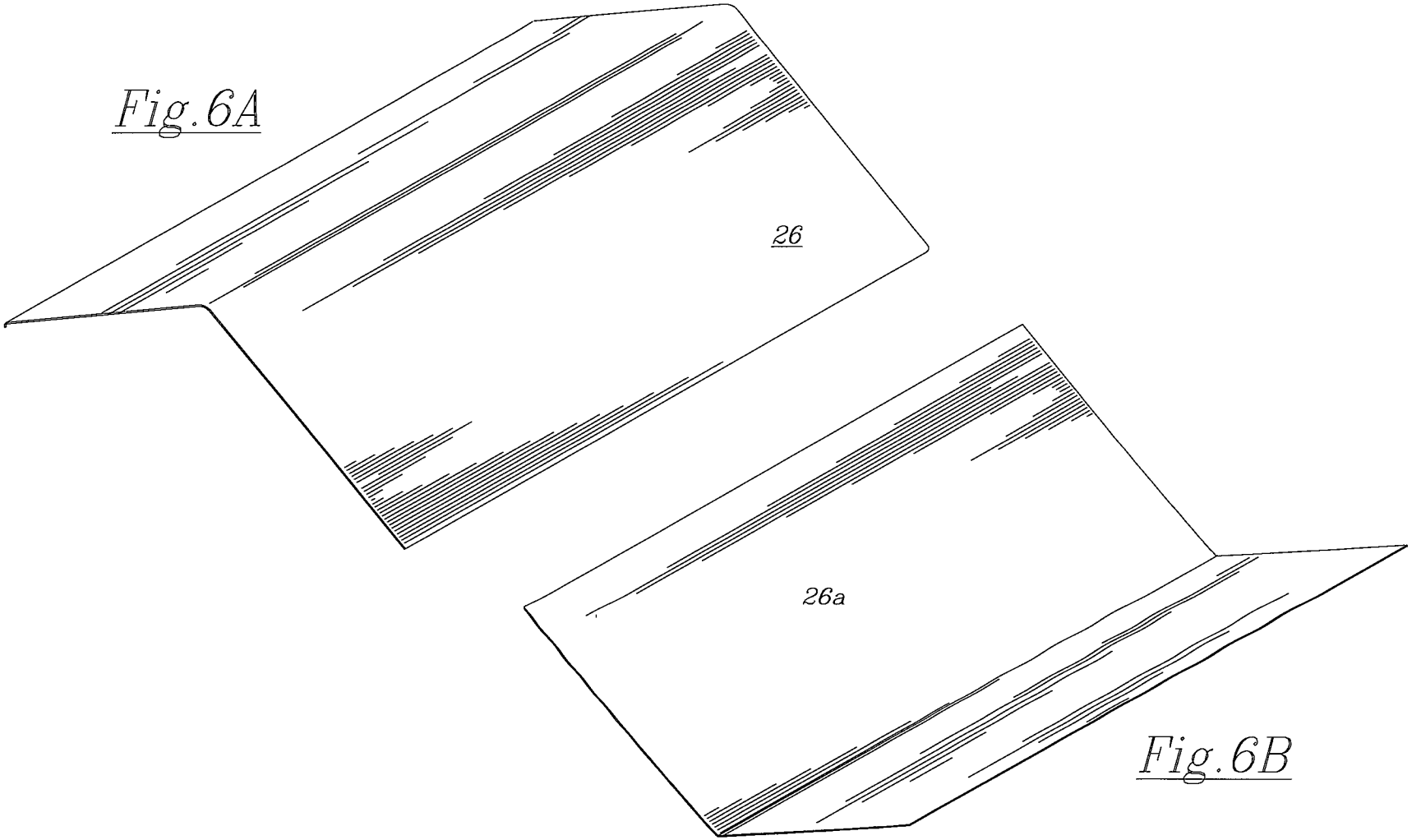
FIG. 6A is a perspective view of the exterior of a roof cap panel to be used along the ridge of the roof or dormer of a structure.
FIG. 6B is a perspective view of the interior of an inverted roof cap panel to be used in the valley between adjacent upwardly angled roof sections.

Referring now to FIGS. 6A and 6B, the ridge cap member 26 is invertible to form a gutter or valley member 26*a* that is positioned between flat sections of the roof that extend away from each other at 45° or greater angles to collect and channel downward runoff water from the adjacent roof sections. See, FIG. 6B. The valley member 26*a* is usually placed along an angled joint between adjacent inclined roof sections to collect and direct runoff water down the valley between the roof sections and to the roof gutter of the structure. As shown in FIG. 1, the valley member 26*a* overlies the adjacent roof panels 12 and is held in place by a fastener that extends through the roof panels 12 along both sides of the valley and into the underlayment or decking material to hold the valley member 26*a* in place. In this manner, the valley member 26*a*, in conjunction with the roof panels 12, form a substantially flat surface such the runoff water continues downward without impediment or having to overcome a rise in the outer surface of the panels 26, 12, or 26*a* of the metal roofing system 10.

Figure 5:
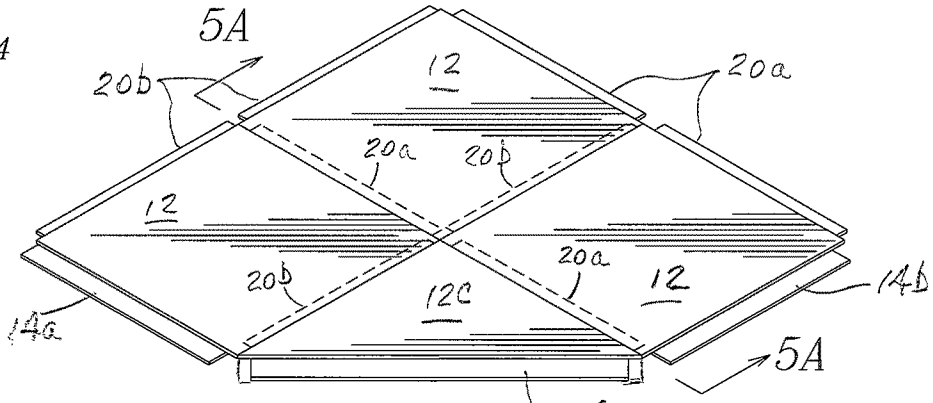
FIG. 5 is a perspective view of an array of several interlocked panels of the formed metal panel roof system of the present invention indicating the insertion of the engaging flange of a first formed panel with the cooperating pocket of an adjacent second formed panel and the overlap of the outer skin of the second formed panel over onto the first formed panel.
Figure 5A:
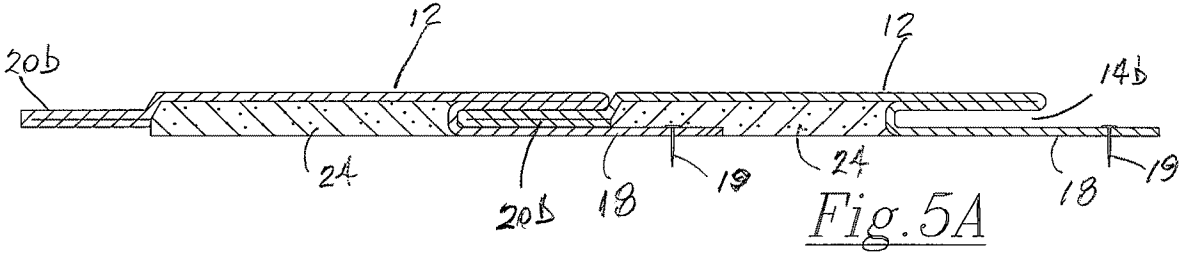
FIG. 5A is a sectional view taken along Line 5A-5A of FIG. 5.

As described above, the roof panel member 12 has a first straight flat outwardly projecting flange member 20*a* that extends along almost one entire upward facing side of the panel and a second adjacent straight flat outwardly projecting flange member 20*b*, which extends along almost the entire other upward facing side of the panel 12. The outwardly projecting flange members 20*a*, 20*b* are arranged to interlock seamlessly and to overlay with one or more adjacent panels 12 by sliding into the opposing receiving pockets 14*a*, 14*b* of an adjacent panel 12, forming an interlocking metal roof system for a structure as shown in FIGS. 1 and 5. Each receiving pocket 14*a*, 14*b* is dimensioned to about 1-2 inches in depth and about 9/64 of vertical height. The interstitial space formed within the receiving pockets 14*a*, 14*b* is nominally the thickness of the projecting flange members 20*a*, 20*b* that extend into the receiving pockets 14*a*, 14*b* when the panels 12, 12*b*, 12*c* and 12*d* are interlocked together. Upon interlocking, the various panels, 12, 12*b*, 12*c* and 12*d*, form a substantially uniform, continuous flat surface that is strong enough to walk on.

Each of the metal roofing panel members 12, 12*b*, 12*c* and 12*d* are dimensioned to be perfectly rectilinear so that when butted together each panel precisely fits into the other when interlocked. In this manner the connection points and fastening means are hidden from view as shown with the assembled and interlocked panel members 12, and 12*b*, 12*c* and 12*d*, in FIGS. 3 and 5. The outer surface areas of the panels 12, as they are interlocked together, and 26, 26*a* as they are affixed atop the panels 12, form a substantially uniform surface that allows water and other run off to move downward over the metal panel roofing system 10 and prevent the water from collecting on or penetrating through the roof.

The first installed member of the roofing system is the ridge panel 12*b*, shown in FIGS. 1, 2, 3 and 3A. These roof ridge panels 12*b* are set along the length and on both sides of the roof ridge line 11 and secured in place using the tabs 22*b*, 22*b*' along with fasteners 19 inserted through the nailing hem 18 along the downward facing sides of the roof ridge panels 12*b*. Next the upward facing flanges 20*a*, 20*b* of the first half-course of panels 12 are inserted into the receiving pockets 14*a*, 14*b* in each of the roof ridge panels 12*b* arrayed along one inclined slope of the roof and the panels 12 are secured in place by fasteners 19 through their respective nailing hems 18. With the first half-course of panels 12 in place, the roof cap 26 can be placed atop the ridge line 11 and secured in place as shown in FIG. 1. This part of the metal roofing system may be the same or the preferred larger dimensional length than the standard roof panels 12. The ridge cap member 26 is bent or folded along its centerline at an adjustable angle to fit snugly over the roof ridgeline or the top edge of a dormer located on the structure. The bend is not preset and is intended to be flexible to accommodate inclined or steep roofs of different pitches. The ridge cap 26 overlays a portion of the roof ridge panels 12*b* and the standard panels 12 and is secured in place by fasteners inserted through the panels 12, 12*b* to any rigid underlayment. In addition, a sealant can be used along the underside of the ridge cap 26 to engage with the outer surface of the panels 12, 12*b* along the entire length of the roof. In this manner, an impenetrable seal or joint is created between the ridge cap member 26 and one or more roof panel members 12, 12*b*.

The step of inserting roof panels 12 is repeated each half-course as described above. At the roof edges, right and left side roof panels 12*d* are used to meet the roof edge. The upward facing flanges 20*a* or 20*b* are inserted into receiving pockets 14*a*, 14*b*, respectively, of the adjacent panels 12 and the panels 12*d* are secured in place through their nailing hems 18 with fasteners 19. After each course of panels 12 is mounted to the roof, another side roof panel 12*d* is placed and secured in position. The overhanging fascia flange 22*d* may be secured at the time of installing the roof edge panel 12*d*, or at a later time when finishing the roof edges. In the event that the side roof panels 12*d* extend beyond the roof decking, they can be cut off at the end of the roof deck and a roof cap member 26 can be used to secure a series of adjacent panels 12*d* to the underlayment and to the side fascia of the roof. An example of this alterative manner of securing the side roof panels 12*d* is shown in FIG. 1.

When the bottom of the roof is reached, bottom edge panel 12*c* is used to finish off the metal roof system 10 by inserting the upward facing flanges 20*a*, 20*b* into the respective receiving pockets 14*a*, 14*b* of the adjacent panels 12. The bottom edge 22*c* of the bottom edge panel 12*c* is extended over the roof edge and over the fascia below and secured in place by fasteners. In this manner the newly installed roof panels are positioned and fastened in place without having to walk over already installed panels to reach the next panels to install. Further, the metal roof panel system 10, as installed in accordance with the invention, creates a thermally insulative, sound deadening, self-sealing, non-visible interlocking system of formed sheet metal shingles that provide substantially watertight seams between adjacent shingles without the need for additional sealant materials.

The present invention provides for the installing of the metal roofing system 10 beginning at the ridgeline of the roof and working downward, rather than starting at the bottom of the roof and working upward. This enables the installer to lay down metal roof panels without having to walk over already installed panels, or to create elaborate systems to prevent damage to the already installed new roofing system. Further, the new roof surface is not traversed by the installer prior to completion allowing for more intact overlying joints between panels.

Figure 7A:
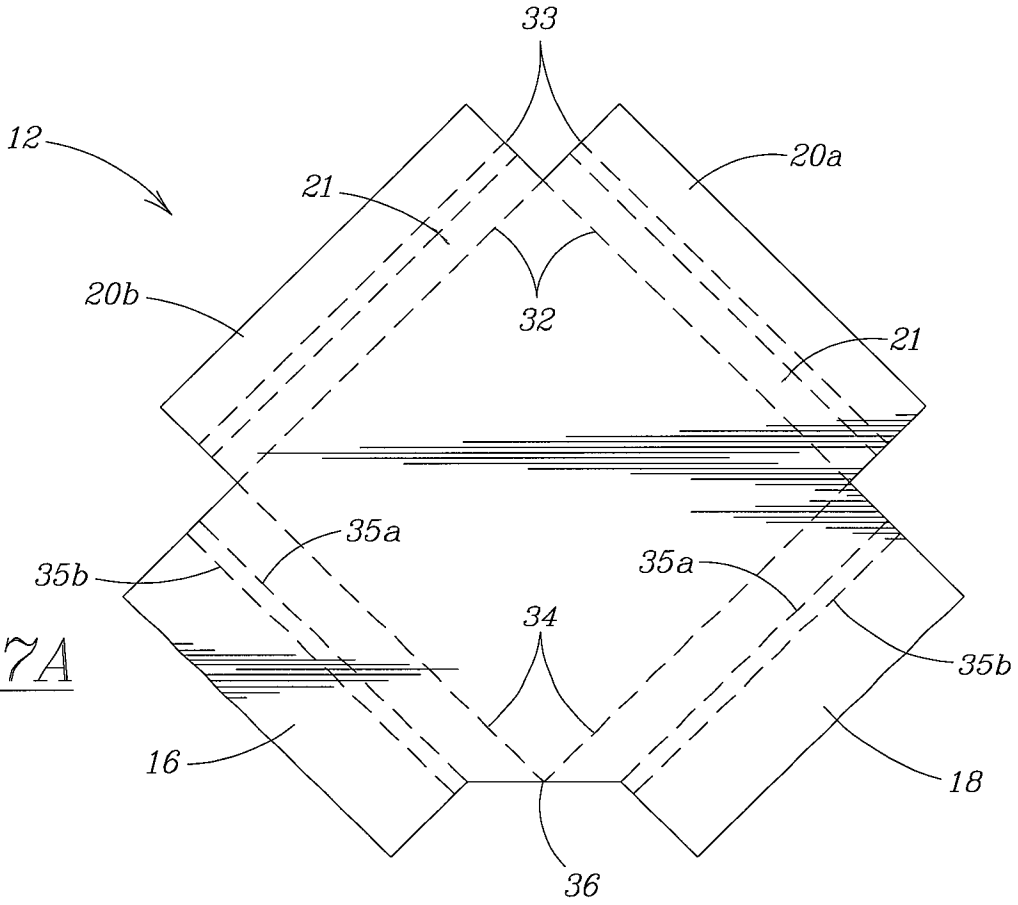
FIG. 7A is a plan view of a metal panel roof member of the present invention indicating the bends or fold lines for forming the individual panel.

Referring now to FIGS. 7A-7E, there are shown a series of blanks that are formable into the several panels 12 and 12*b*-12*d* to form each of the formed panels of the metal roof system 10 of the present invention. The sheet metal blanks are not shown with specific dimensions as the dimensions may vary due to roof size which, in turn, will vary the dimensions of the metal shingles. Further, the fold lines shown on the sheet metal blanks are only approximate placements as the size and precise location of a fold will depend upon the thickness of the metal sheet and the dimensions of the receiving pockets and extending flanges. FIG. 7A shows (in dashed lines) the several fold lines in the metal blank to create the panel 12. In the orientation shown, the two upward facing sides of the panel 12 are folded along lines 32 to form the downward detent 21 in the outer surface of panel 12. To form the upward extending flanges 20*a*, 20*b*, the blank is folded over itself along lines 33. On the opposite two sides, the sides facing downward, the extending parts of the blank are folded inward and downward along lines 34 to begin the formation of the receiving pockets 14*a*, 14*b*. Then the two extending parts of the blank are folded again along lines 35*a* and 35*b* to form the pockets with the proper separation and extend outward completing the receiving pockets 14*a*, 14*b* and creating the nailing hems 16, 18. In this way the top surface of the receiving pockets 14*a*, 14*b* overlies the adjacent detent 21 in the top surface along the extending flanges 20*a*, 20*b* with the point 36 between the downward facing sides of the panel 12 overlying the detents 21 at the junction among up to four panels over the course of installation on an inclined roof.

Figure 7C:
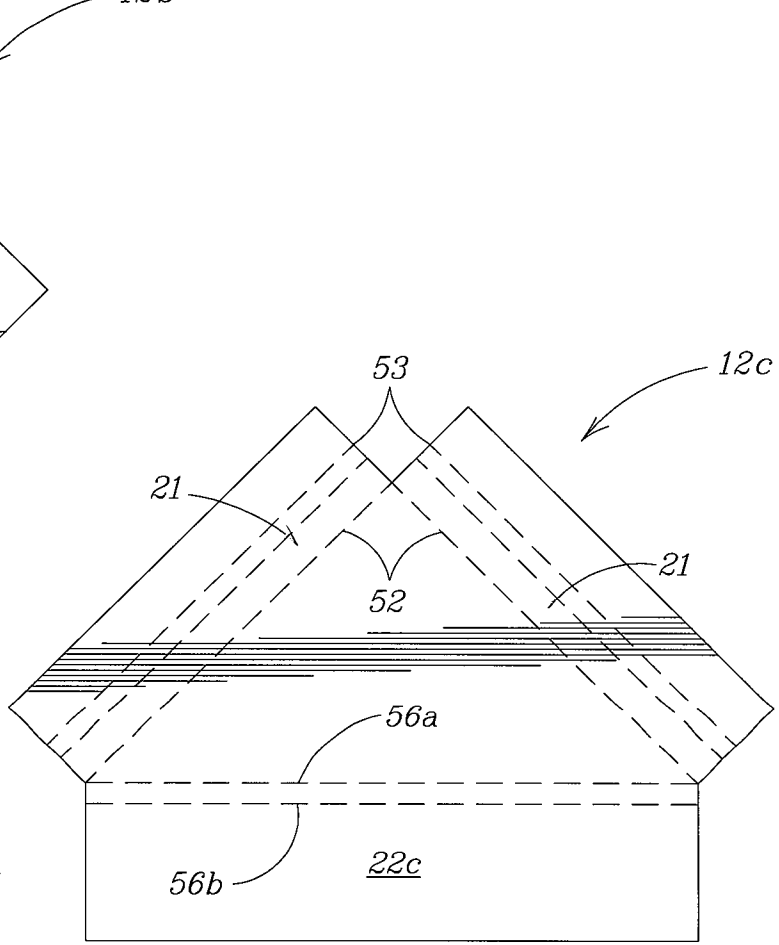
FIG. 7C is a plan view of a bottom edge metal panel roof member of the present invention indicating the bends or fold lines for forming the individual panel.
Figure 7B:
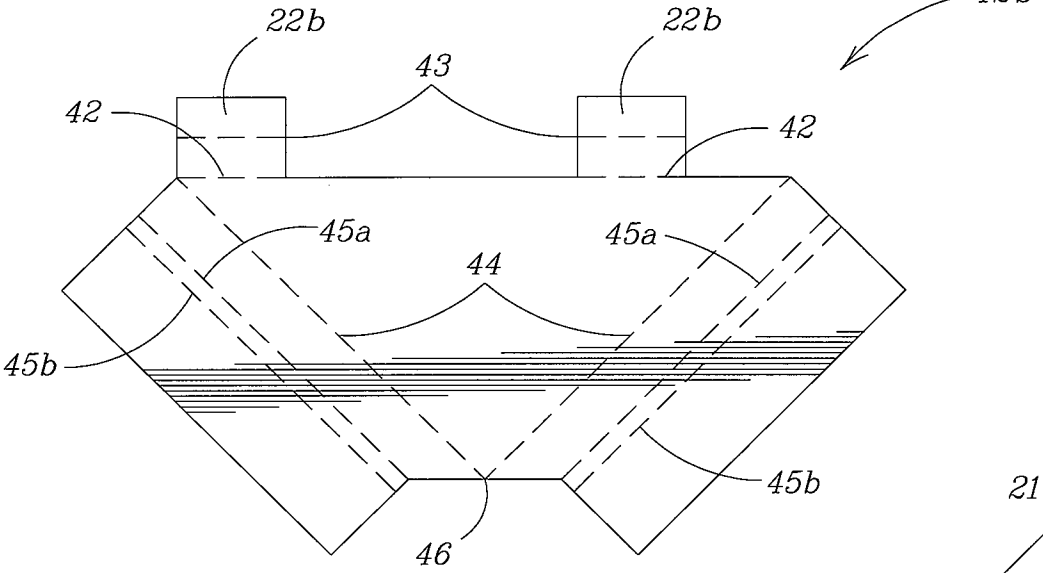
FIG. 7B is a plan view of a top or ridge metal panel roof member of the present invention indicating the bends or fold lines for forming the individual panel.

FIG. 7B shows (in dashed lines) the fold lines to create the panel 12*b*. In the orientation shown, the tabs 22*b* along the upward facing side of the panel 12*b* are formed by folding downward along lines 42 and then outward along lines 43. On the sides facing downward, the extending parts of the blank are folded inward and downward along lines 44 to begin the formation of the receiving pockets 14*a*, 14*b*. Then the two extending parts of the blank are folded again along lines 45*a* and 45*b* to form the pockets with the proper separation and to extend outward completing the receiving pockets 14*a*, 14*b* and creating the nailing hems 16, 18. In this way the top surface of the receiving pockets 14*a*, 14*b* overlies the adjacent detent 21 in the top surface along the extending flanges 20*a*, 20*b* with the point 46 between the downward facing sides of the panel 12*b* overlying the detents 21 at the junction among three panels.

FIG. 7C shows (in dashed lines) the fold lines to create the panel 12*c*. In the orientation shown, the two upward facing sides of the panel 12*c* are folded along lines 52 to form a downward detent 21 in the outer surface of panel 12*c*. To form the upward extending flanges 20*a*, 20*b*, the blank is folded over itself along lines 53. Along the bottom of the blank the extension is folded downward along line 56*a* to form one wall of the recess holding the insulating member 24 and along line 56*b* to create the fascia covering as described above. This covering extends across the entire bottom side of the panel 12*c* and abuts against same fascia covering extension of adjacent panels 12*c*.

Figure 7E:
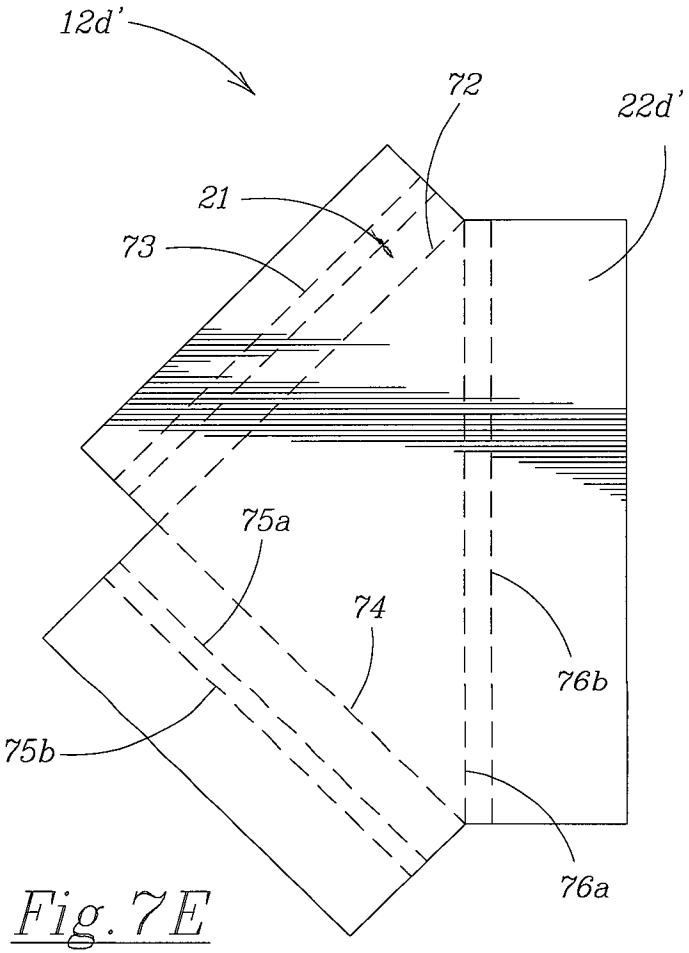
FIG. 7E is a plan view of a right edge metal panel roof member of the present invention indicating the bends or fold lines for forming the individual panel.
Figure 7D:
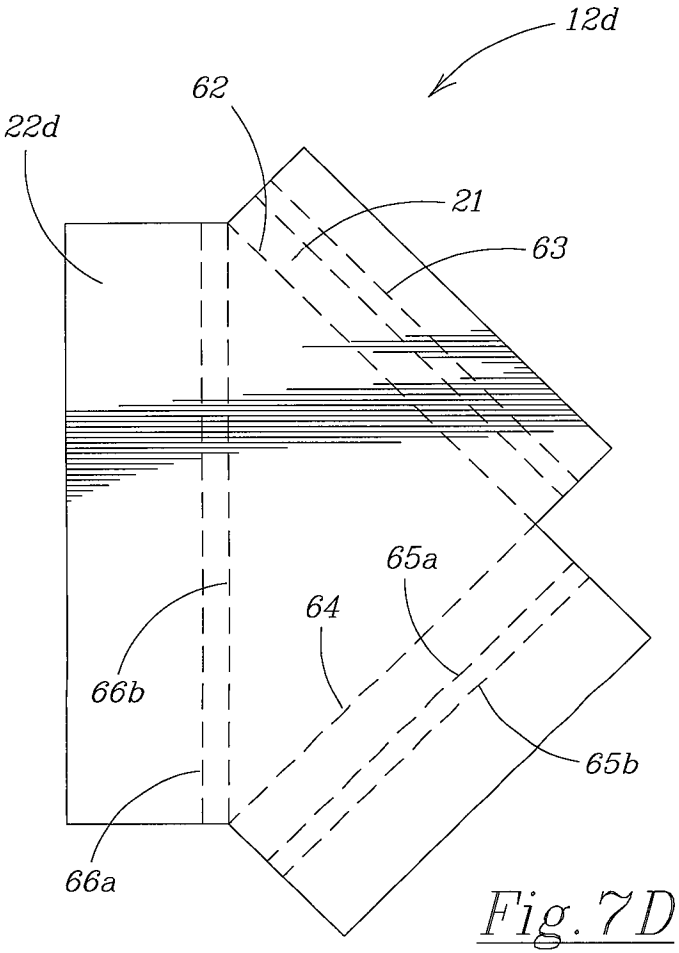
FIG. 7D is a plan view of a left edge metal panel roof member of the present invention indicating the bends or fold lines for forming the individual panel.

FIGS. 7D, 7E show (in dashed lines) the fold lines to create the left and right side roof panels 12*d* and 12*d*', respectively. Referring to FIG. 7D, in the orientation shown, the upward facing side of panel 12*d* is folded in similar fashion to that of panel 12. To form the upward extending flange 20*a*, the upward facing side of the panel 12*d* is folded along line 62 to form a downward detent 21 in the outer surface of panel 12*d* and then folded over itself along line 63. On the opposite side, the side facing downward, the extending part of the blank is folded inward and downward along line 64 to begin the formation of the receiving pocket 14*b*. Then the extending part of the blank is folded again along line 65*a* and 65*b* to form the pocket with the proper separation and to extend outward completing the receiving pocket 14*b* and creating the nailing hem 18. On the long side of the panel 12*d*, the blank is folded along line 66*b* to form one wall of the recess holding the insulating member 24 and along line 66*a* to create the fascia covering that overlies the side of the roof decking and connects to the fascia below. The fascia covering extends along the entire side of the panel 12*d* and abuts against the same fascia covering extension of adjacent panels 12*d* along the entire length of the roof side.

Referring now to FIG. 7E, in the orientation shown, the upward facing side of panel 12*d*' is folded in similar fashion to that of panel 12. To form the upward extending flange 20*b*, the upward facing side of the panel 12*d* is folded along line 72 to form a downward detent in the outer surface of panel 12*d*' and then folded over itself along line 73. On the opposite side, the side facing downward, the extending part of the blank is folded inward and downward along line 74 to begin the formation of the receiving pocket 14*a*. Then the extending part of the blank is folded again along line 75*a* and 75*b* to form the pocket with the proper separation and to extend outward completing the receiving pocket 14*a* and creating the nailing hem 16. On the long side of the panel 12*d*', the blank is folded along line 76*a* to form one wall of the recess holding the insulating member 24 and along line 76*b* to create the fascia covering that overlies the side of the roof decking and connects to the fascia below. The fascia covering extends along the entire side of the panel 12*d*' and abuts against the same fascia covering extension of adjacent panels 12*d*' along the entire length of the roof side.

The structural foam insulation 24 that is placed within the formed downward facing opening or recess of the various panels 12 and 12*b*-12*d* can be any one of a number of materials. The structural insulative material can be manufactured from molded expanded polystyrene (EPS), extruded polystyrene (XPS), urethane foam, or isocyanate foam. All of these materials exhibit a similar structural non-compression property and serve as insulative materials captive within the downward facing pocket of the panels 12 and 12*b*-12*d* installed on the roof. The materials are light weight, but once formed, resist compression sufficiently to prevent the roof panels 12 and 12*b*-12*d* from bending inward toward the roof decking when walked on. The insulative factor in R-value can only be approximated at about R5-R10 and will depend upon the density of the foam insulative material. The foam density is preferred to be greater, on the order of 1.5-2.0 lb/ft$^3$, in order to both provide the structural integrity, as well as adding to the insulative value of the roofing materials. The increased density permits for less temperature transmission through the roofing material in both cold and hot environments. Further, the increased density of the foam also decreases water vapor permeance through the materials virtually eliminating leaks through the insulative material in the roof panels 12 and 12*b*-12*d*. In addition, the density will also deaden or reduce sound transmission through the panels 12 and the roof decking materials.

Figure 8:
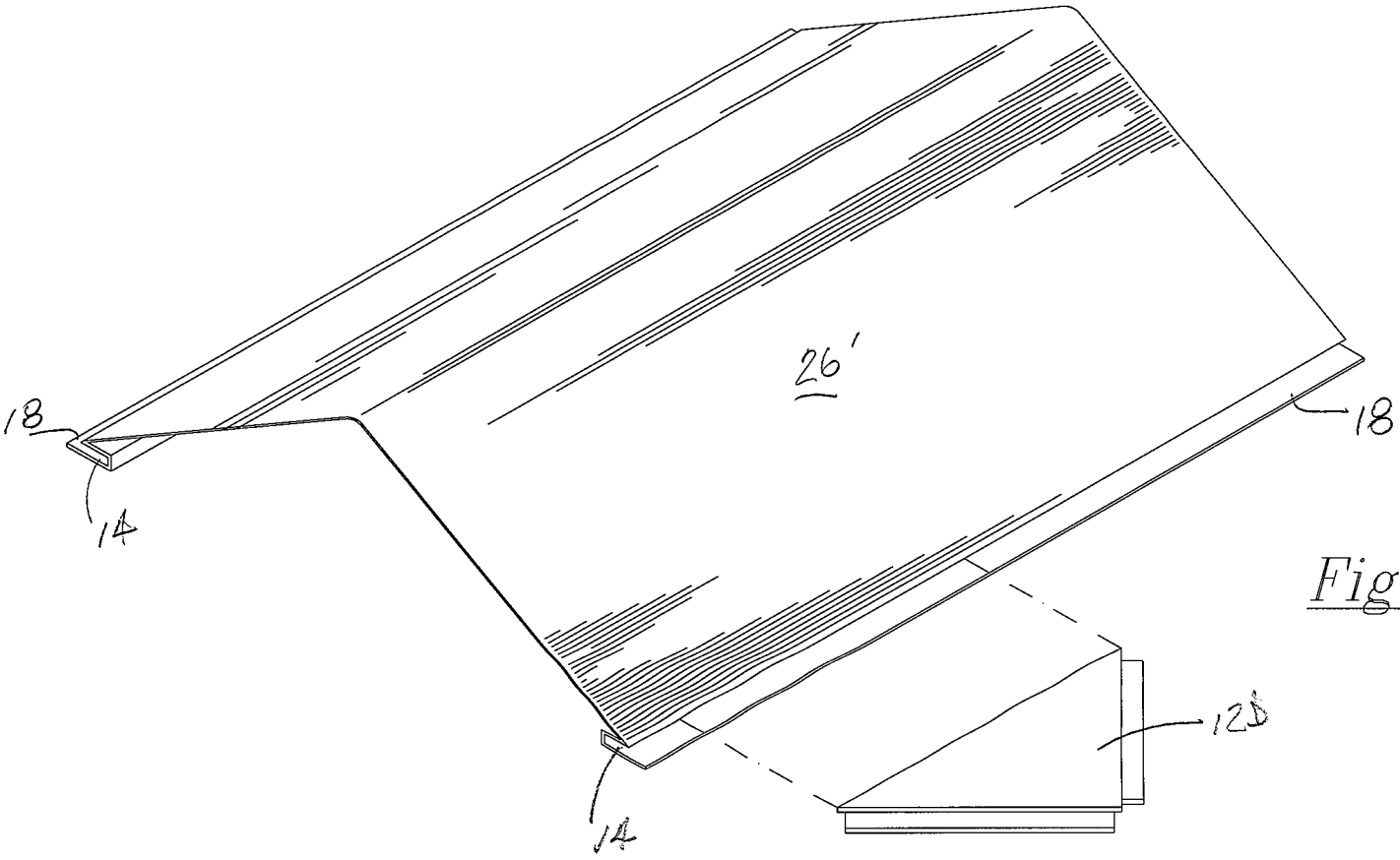
FIG. 8 is a perspective view of a first roof capping member for placement over and straddling the roof ridge capable of receiving formed panels along the lengthwise edge.

An alternative to using the roof cap members 26 covering several of the panels 12, 12*b* is to provide another roof cap member 26' that can be installed directly over the roof decking material. With reference to FIG. 8, roof cap member 26' is positioned at one end of the roof ridge line 11 and secured in place using the nailing hems 18. Several of the roof cap member 26' will be required to span the entire length of the roof ridge 11 and the edge of one roof cap 26' will overlay the adjacent roof cap 26' to create a joint in the same fashion as the roof cap members 26. Once fixed in position, modified roof ridge panel member 12*b*, having their tabs 22*b* cut off, are positioned within the formed pockets 14 extending along the length of the roof cap 26'. The roof cap 26' extends outward and overlays the roof panel member 12*b* a predetermined distance to permit the easy flow of water and other condensate downward and off the roof system. The roof cap member 26' is capable of accommodating several roof ridge panel members 12*b* along its length with the intention of a roof ridge panel 12*b* spanning the joint between two adjacent roof cap members 26' for added strength and leak avoidance integrity. The roof ridge panels 12*b* are secured to the roof deck in the same manner as described above, as well as the remainder of the metal panel roof system.

Figure 9:
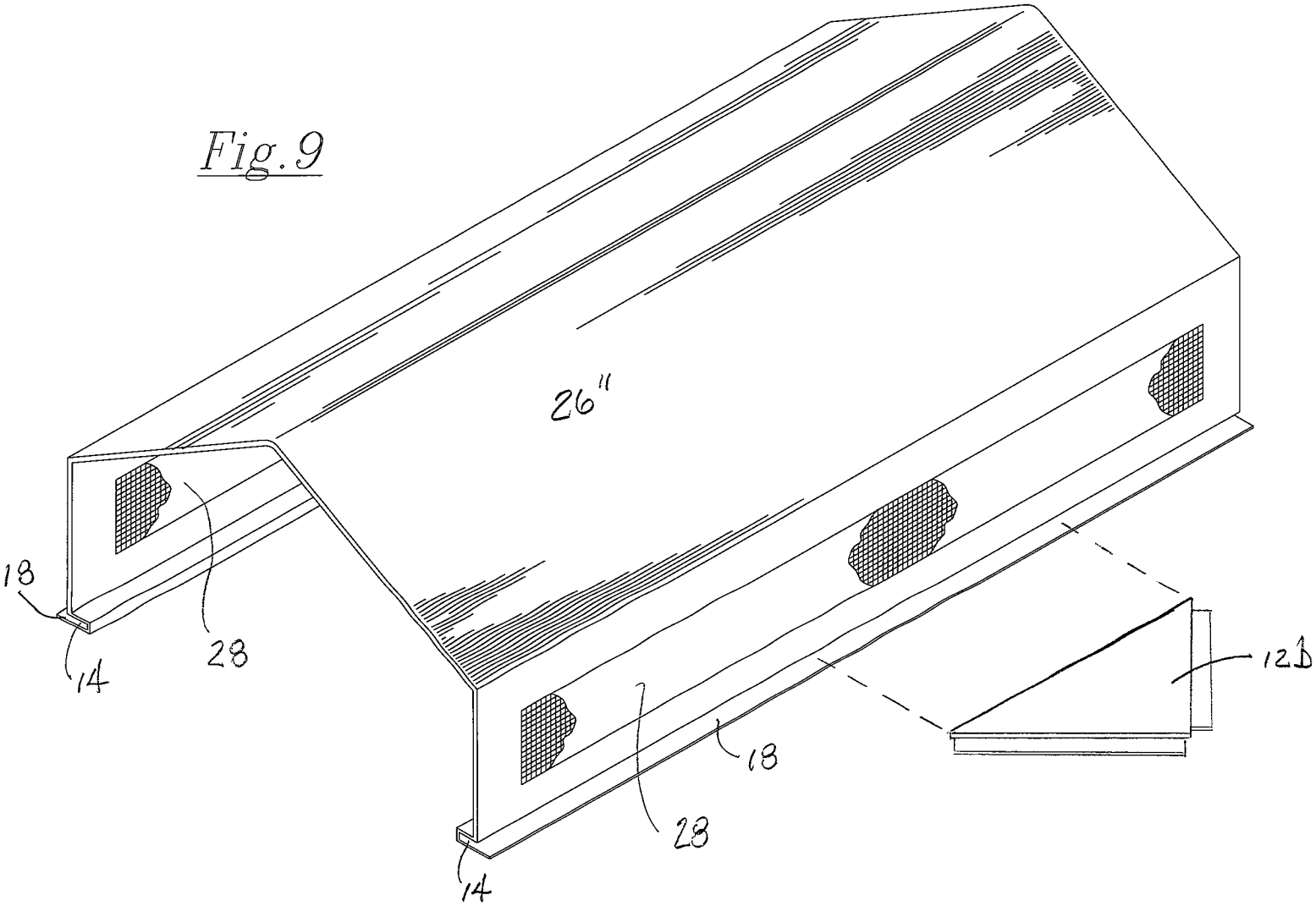
FIG. 9 is a perspective view of a second roof capping member having longitudinally arrayed venting for placement over and straddling the roof ridge capable of receiving formed panels along the lengthwise edge.

In the event the roof requires venting, another form of roof cap is shown in FIG. 9. Roof cap member 26" is configured with opposing vent panels 28 arrayed in each of the opposing vertical extension sides of the roof cap member 26". The vent panels 28 are shown in an oversized manner as the precise dimensions will depend upon the volume of air to be vented and the size of the roof. The roof cap member 26" is positioned at one end of the roof ridge line 11 and secured in place using the nailing hems 18. Several of the roof cap member 26" will be required to span the entire length of the roof ridge 11 and the edge of one roof cap 26" will overlay the adjacent roof cap 26" to create a joint in the same fashion as the roof cap members 26. Once fixed in position, modified roof ridge panel member 12*b*, having their tabs 22*b* cut off, are positioned within the formed pockets 14 extending along the length of the roof cap 26". The roof cap 26' extends outward and overlays the roof panel member 12*b* a predetermined distance to permit the easy flow of water and other condensate downward and off the roof system. The roof cap member 26" is capable of accommodating several roof ridge panel members 12*b* along its length with the intention of a roof ridge panel 12*b* spanning the joint between two adjacent roof cap members 26" for added strength and leak avoidance integrity. The roof ridge panels 12*b* are secured to the roof deck in the same manner as described above, as well as the remainder of the metal panel roof system.

The lightweight metal roof capping system 10 may be installed over the roof decking materials, or over a pre-existing shingle roof system, for roofs that are considered steep or inclined. An installer may also enclose an interposed layer of closed cell insulation, which insulation layer and rigid backing material may be placed onto and secured to the roof before installing the interconnecting roof panels 12 and 12*b*-12*d* to create a higher rated insulation barrier. In all instances the metal roofing system 10 is installed from the ridgeline 11 of the roof downward with the roof ridge panels 12*b* and the roof cap members 26, 26' or 26" being installed first and the panels 12 and 12*c*, 12*d* and 12*d'* being installed in an increasing downward direction away from the roof ridge. In this fashion, an installer is neither required to construct a complex support system to create a barrier between the installer, the support system and the metal roofing materials in order not to damage these materials. Since present shingle systems are installed from the roof gutter upwards to the roof ridgeline, an installer has to work over and on top of newly installed shingles giving rise to the potential for damage to the newly installed roof. Without having to retrace one's steps by overlying the newly installed roof, by working from the top down, an installer saves time and labor costs and will not place the newly installed roofing system in position for potential damage by the workmen installing the roof.

Those skilled in the art may perceive improvements, changes and modifications in the invention, all of which are intended to be covered by and included within the scope of the claims set forth herein, and that all matter contained in the accompanying specification shall be interpreted as illustrative only and not in a limiting sense. The present invention may also be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention, as well as all modifications which may fall within a range of equivalency which are also intended to be embraced therein.

The invention claimed is:

1. An interlocking roof system that inter-engages a plurality of preformed thermally insulative metal panels to create an integral roof surface over roof decking or an existing roofing system of a structure said interlocking roof system comprising:

one or more ridge cap means for positioning along the ridgeline of a structure roof each arrayed longitudinally along the ridgeline with the next from one roof edge to the opposite roof edge, each said ridge cap means including a plurality of triangularly shaped panels having a substantially planar outward facing central surface with a pair of flanges outwardly extending downwardly across the roof from equal length sides, each flange arranged at right angles to the other flange, with receiving pockets dimensionally sized and adapted for receiving within said pockets upwardly extending cooperating flanges from adjacently placed rectilinearly shaped roof panel members and interlocking therewith;

said rectilinearly shaped roof panel members having a substantially planar outward facing central surface with equal length sides arrayed on the roof a half panel member span below said triangularly shaped panel members or other adjacent roof panel members with a first set of opposite corners one above the other in a vertical line substantially in parallel relationship to the roof edges and a second set of opposite corners in a horizontal line substantially in parallel relationship to the ridgeline or eave edge of the roof, said rectilinearly shaped roof panel members having flanges outwardly extending downwardly across the roof, along adjacent downward facing sides thereof, with receiving pockets having a predetermined depth dimensionally sized and adapted for receiving within said pockets upwardly extending cooperating flanges from other adjacently placed roof panel members and interlocking therewith;

said rectilinearly shaped roof panel members having upper side indents along the entire length of each upper side extending into the planar central surface and an upwardly extending flange having a predetermined length dimensionally sized and adapted for fitting within and frictionally engaging with the cooperating pockets of adjacent roof panel members;

said outwardly extending flanges of the triangularly shaped and the rectilinearly shaped roof panel members extending downwardly along the roof each having a lower extension extending beyond the predetermined depth of said receiving pockets for receiving mechanical fasteners for securing said panel members to the roof and an upper extension beyond said pockets for overlying the interlocking flanges and receiving pockets between adjacent panel members a predetermined distance along the upper surface of adjacent roof panel members and overlying the opposing upper side indents in said adjacent panel members; and said substantially planar centrally disposed surfaces of each said triangularly shaped and the rectilinearly shaped roof panel members each being formed with a recess on its inward facing surface bordered by the several flanges for housing a structural foam member for providing both thermal insulation and central support for said panel members creating a substantially uniform height continuous integral surface for said roofing system.

2. The interlocking roof system of claim 1, wherein roof panel members extending over the roof edges capable of being trimmed to dimensionally match the roof edge and have a rolled edge for extending over and beneath the roof edge to prevent wind uplift along said roof edge.

3. The interlocking roof system of claim 1, wherein said outwardly extending flanges projecting downward along the roof of said triangularly shaped and the rectilinearly shaped roof panel members through which said mechanical fasteners extend and said pockets for receiving cooperating flanges are covered over by the adjacent panel members hiding all connection points and creating said substantially uniform height continuous integral surface for said roofing system.

4. The interlocking roof system of claim 1, wherein said one or more ridge cap means being a capping panel member extending over portions of the triangularly shaped and the rectilinearly shaped roof panel members adjacent to the ridge line.

5. The interlocking roof system of claim 1, wherein said one or more ridge cap means being a ridge line spanning panel member having receiving pockets along each opposing edge for receiving triangularly shaped roof panel members.

6. The interlocking roof system of claim 5, wherein said one or more ridge cap means includes one or more vents arrayed in opposing vertical sidewalls of the ridge line spanning panel member.

7. A method for installing an interlocking roof system that inter-engages a plurality of panels to create an integral roof surface over roof decking or an existing roofing system of a structure said method of installing the interlocking roofing system comprising the steps of:

positioning one or more ridge cap means for positioning along the ridgeline of a structure roof each arrayed longitudinally along the ridgeline with the next from one roof edge to the opposite roof edge, each said ridge cap means including a plurality of triangularly shaped panels having a substantially planar outward facing central surface with a pair of flanges outwardly extending downwardly across the roof from equal length sides, each flange arranged at right angles to the other flange, with receiving pockets dimensionally sized and adapted for receiving within said pockets upwardly extending cooperating flanges from adjacently placed rectilinearly shaped roof panel members and interlocking therewith;

aligning each of said one or more ridge cap means along a horizontal line extending across the roof of the structure and securing said ridge cap means to the roof by mechanical fasteners placed through the downwardly extending flanges creating a horizontally aligned first course of panel members;

providing said rectilinearly shaped roof panel members having a substantially planar outward facing central surface with equal length sides arrayed on the roof a half panel member span below said triangularly shaped panel members or other adjacent roof panel members with a first set of opposite corners one above the other in a vertical line substantially in parallel relationship to the roof edges and a second set of opposite corners in a horizontal line substantially in parallel relationship to the ridgeline or eave edge of the roof, said rectilinearly shaped roof panel members having flanges outwardly extending downwardly across the roof, along adjacent downward facing sides thereof, with receiving pockets having a predetermined depth dimensionally sized and adapted for receiving within said pockets upwardly extending cooperating flanges from other adjacently placed roof panel members and interlocking therewith;

positioning said one or more rectilinearly shaped roof panel members in a staggered array of additional courses of panel members extending from the ridgeline downward along the roof into the pockets of the immediately adjacent panel member already secured to the roof and covering over the flange and fasteners used to secure the earlier secured courses of panel members;

providing within said substantially planar centrally disposed surfaces of each said triangularly shaped and the rectilinearly shaped roof panel members a recess for housing a structural foam member for providing both thermal insulation and central support for said panel members creating a substantially uniform height continuous integral surface for said roofing system.

8. The interlocking roof installation method of claim 7, comprising the additional steps of trimming roof panel members extending over the roof edges to dimensionally match the roof edge and creating a rolled edge along the trimmed side of said panel member for extending over and beneath the roof edge to prevent wind uplift along said roof edge.

9. The interlocking roof installation method of claim 7, forming a cascading downward step as the staggered panel members are interconnected into courses from the ridgeline of the roof to the bottom allowing water and other run off to move downward over the substantially uniform roof surface formed by the inter-engaged plurality of ridge cap and panel members.

10. The interlocking roof installation method of claim 7, wherein said ridge cap means being a capping panel member extending over portions of the triangularly shaped and the rectilinearly shaped roof panel members adjacent to the ridge line.

11. The interlocking roof installation method of claim 7, wherein said ridge cap means being a roof ridgeline spanning panel member having receiving pockets along each opposing edge for receiving triangularly shaped roof panel members.

12. The interlocking roof installation method of claim 11, wherein said ridge cap means includes one or more vents arrayed in opposing vertical sidewalls of the roof ridgeline spanning panel member.

* * * * *